US012723829B1

(12) United States Patent
Lau

(10) Patent No.: US 12,723,829 B1
(45) Date of Patent: Sep. 1, 2026

(54) TRIGGER MECHANISM

(71) Applicant: Shui Lau, Lewis Center, OH (US)

(72) Inventor: Shui Lau, Lewis Center, OH (US)

( * ) Notice: Subject to any disclaimer, the term of this patent is extended or adjusted under 35 U.S.C. 154(b) by 26 days.

(21) Appl. No.: 19/032,173

(22) Filed: Jan. 20, 2025

(51) Int. Cl.
*F41A 19/10* (2006.01)
*F41A 19/12* (2006.01)
*F41A 19/42* (2006.01)

(52) U.S. Cl.
CPC ..... *F41A 19/42* (2013.01)

(58) Field of Classification Search
CPC ..... F41A 19/12; F41A 19/42; F41A 19/44; F41A 19/14
See application file for complete search history.

(56) References Cited

U.S. PATENT DOCUMENTS 313,213 A * 3/1885 Kelton ..... F41A 9/18 42/37
683,072 A * 9/1901 Roth et al. ..... F41A 19/30 89/154
1,200,685 A * 10/1916 Young ..... F41A 19/33 89/44.01
1,277,379 A * 9/1918 Chadwick et al. ..... F41A 19/30 89/145
1,545,034 A * 7/1925 Burns ..... F41B 7/025 473/589
1,693,530 A * 11/1928 Spencer ..... F41A 19/30 42/16
1,756,271 A * 4/1930 Wiley ..... F41A 19/53 42/51
1,818,810 A * 8/1931 Miller ..... F41B 11/51 124/76
2,379,461 A * 7/1945 Simpson ..... F41A 19/03 89/198
2,464,427 A * 3/1949 Wilson ..... F41A 19/48 89/147
2,846,925 A * 8/1958 Norman ..... F41A 17/38 89/196
3,441,270 A * 4/1969 Nielsen ..... A63F 9/0252 472/63
3,442,173 A * 5/1969 Muller ..... F41A 19/21 42/105
3,824,981 A * 7/1974 Crane ..... F41B 11/62 124/40
4,023,296 A * 5/1977 Frisoli ..... F41A 19/42 42/69.03
4,321,764 A * 3/1982 Wilhelm ..... F41A 19/14 89/196

(Continued)

*Primary Examiner* — Derrick R Morgan
(74) *Attorney, Agent, or Firm* — Shaddock Law Group, PC

(57) ABSTRACT

A trigger mechanism, including a trigger having a trigger shoulder; a trigger sear having a trigger sear shoulder, and wherein the trigger and the trigger sear are positioned such that at least a portion of the trigger shoulder is able to at least partially contact at least a portion of the trigger sear shoulder; a hammer sear having a hammer sear shoulder; a hammer having a hammer shoulder, and wherein the hammer and the hammer sear are positioned such that at least a portion of the hammer shoulder is able to at least partially contact at least a portion of the hammer sear shoulder; and a trigger bar, wherein if the trigger is rotated, the trigger releases the trigger sear, which, urges the trigger bar, which, rotates the hammer sear, which, releases the hammer.

20 Claims, 7 Drawing Sheets

(56) References Cited

U.S. PATENT DOCUMENTS 4,866,869 A * 9/1989 Mainland ..... F41A 17/62 42/70.08
5,088,222 A * 2/1992 Larson ..... F41A 17/56 42/70.04
5,320,023 A * 6/1994 Erdem ..... F41A 19/43 89/146
5,359,799 A * 11/1994 Moon ..... F41A 19/10 89/136
5,388,362 A * 2/1995 Melcher ..... F41A 17/36 42/70.04
5,426,880 A * 6/1995 Ruger ..... F41A 19/12 89/196
5,797,206 A * 8/1998 Vitorino ..... F41A 11/02 89/147
6,415,702 B1 * 7/2002 Szabo ..... F41A 17/56 42/70.08
9,970,724 B1 * 5/2018 Acker ..... F41A 17/46
10,132,586 B1 * 11/2018 Hoekema ..... F41A 19/29
10,684,087 B2 * 6/2020 Thomele ..... F41A 19/32
12,510,318 B1 * 12/2025 Bray ..... F41A 17/46
2005/0011098 A1 * 1/2005 Fagundes de Campos ..... F41A 17/72 42/70.04
2006/0032101 A1 * 2/2006 Kellermann ..... F41A 19/48 42/69.03
2006/0150466 A1 * 7/2006 Hochstrate ..... F41A 19/14 42/69.03
2011/0232150 A1 * 9/2011 Zukowski ..... F41A 19/10 42/69.01
2021/0088300 A1 * 3/2021 Lipowski ..... F41A 19/12
2022/0244009 A1 * 8/2022 Bognar ..... F41A 19/45
2022/0373283 A1 * 11/2022 Fife ..... F41A 19/31
2025/0035394 A1 * 1/2025 Hamersley ..... F41A 11/02

* cited by examiner

TRIGGER MECHANISM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE DISCLOSURE

1. Field of the Disclosure

The present disclosure relates generally to the field of trigger actuated devices and is particularly directed to a trigger mechanism for a firearm.

2. Description of Related Art

It is known to have a firearm trigger mechanism that includes a linkage or transfer bar to activate a sear, which releases a hammer.

For example, as illustrated, for example, in FIG. 1, a known trigger mechanism 5 includes a trigger 10, a trigger bar 30, a hammer sear 40, and a hammer 50. The trigger 10 includes a trigger pivot aperture 15 and a trigger link aperture 27. The trigger 10 is pivotable about a trigger pivot pin 19 positioned through or at least partially through the trigger pivot aperture 15.

The hammer sear 40 includes a hammer sear pivot aperture 45 and a hammer sear link aperture 47. The hammer sear 40 is pivotable about a hammer sear pivot pin 49 positioned through or at least partially through the hammer sear pivot aperture 45.

The hammer 50 includes a hammer pivot aperture 55 and is pivotable about a hammer pivot pin 59 positioned through or at least partially through the hammer pivot aperture 55.

The trigger bar 30 comprises an elongate portion of material having a trigger bar trigger projection 32 extending from an area proximate a first end of the trigger bar 30 and trigger bar hammer sear projection 34 extending from an area proximate a second end of the trigger bar 30.

The trigger bar 30 is positioned such that the trigger bar trigger projection 32 extends through or at least partially through the trigger link aperture 27 and the trigger bar hammer sear projection 34 extends through or at least partially through the hammer sear link aperture 47.

The trigger mechanism 5 is positioned within a firearm such that the hammer 50 can be maintained in a "cocked" position by interaction of a hammer shoulder of the hammer 50 and a hammer sear shoulder of the hammer sear 40. When the hammer 50 is rotated to the "cocked" position, the hammer shoulder contacts the hammer sear shoulder such that the hammer 50 is maintained in the cocked position. The rotation of the hammer sear 40 is controlled by movement of the trigger bar 30, which is connected directly to the trigger 10. Thus, the movement of the trigger bar 30 is controlled directly by rotational movement of the trigger 10.

If the trigger 10 is urged and pivotably rotated (typically rearward), the rotational movement of the trigger 10 results in direct (typically forward) movement of the trigger bar 30. The movement of the trigger bar 30 results in pivotal rotation of the hammer sear 40.

As the hammer sear 40 is pivotably rotated, at least a portion of the surface of the hammer sear shoulder of the hammer sear 40 slides relative to the hammer sear shoulder of the hammer 50. If the rotation of the hammer sear 40 is sufficient, the surface of the hammer sear shoulder of the hammer sear 40 is translated a sufficient distance so as to disengage the hammer sear shoulder of the hammer 50. If the surface of the hammer sear shoulder of the hammer sear 40 disengages the hammer sear shoulder of the hammer 50 a spring biasing force applied to the hammer 50 allows the hammer 50 to rotate, relative to the hammer pivot pin 59 to contact a firing pin and fire or discharge the firearm.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY AND OBJECTS OF THE DISCLOSURE

Unfortunately, there are a number of shortcomings to these known trigger mechanisms. For example, the direct link between the trigger, trigger bar, and trigger sear introduces sloppiness and a sub-par trigger feel. Additionally, these known trigger mechanisms make it nearly impossible to create a "safe" trigger that has zero pre-travel (aka modern, competition-style 1-stage trigger).

These and other disadvantages of the prior art are overcome with the present disclosure, wherein the trigger mechanism includes a trigger that interacts with an initial sear (or trigger sear) to rotationally alter a rotational position of the initial sear (or trigger sear). The initial sear (or trigger sear) is linked, via a trigger bar, to a second sear (or hammer sear). The second sear (or hammer sear) interacts with a hammer to rotationally alter our intentional position of the hammer. Thus, rotational movement of the trigger activates the initial sear (or trigger sear), activation of the initial sear (or trigger sear) transfers a determined degree of rotational movement to the second sear (or hammer sear), and wherein the determined degree of rotational movement of the second sear (or hammer sear) releases the hammer to fire or discharge the firearm.

In various exemplary, non-limiting embodiments, the trigger mechanism of the present disclosure provides at least some of a trigger, wherein the trigger includes a trigger body portion with a trigger pivot aperture formed therethrough, wherein the trigger pivot aperture is formed proximate an upper portion of the trigger, wherein a trigger shoulder is formed in a portion of the trigger, and wherein a trigger pivot pin is positioned at least partially through the trigger pivot aperture, such that the trigger is pivotable about the trigger pivot pin; a trigger sear, wherein the trigger sear includes an elongate trigger sear body portion having a trigger sear pivot aperture formed proximate a first end of the trigger sear and a trigger sear link aperture formed proximate a second end of the trigger sear, wherein a trigger sear shoulder is formed in a portion of the trigger sear, wherein a trigger sear pivot pin is positioned at least partially through the trigger sear pivot aperture, such that the trigger sear is pivotable about the trigger sear pivot pin, and wherein the trigger and the trigger sear are positioned relative to one another such that at least a portion of the trigger shoulder is able to at least partially contact at least a portion of the trigger sear shoulder; a hammer sear, wherein the hammer sear includes an elongate hammer sear body portion having a hammer sear pivot aperture formed proximate a first end of the hammer sear and a hammer sear link aperture formed proximate a second end of the hammer sear, wherein a hammer sear shoulder is formed in a portion of the hammer sear, and wherein a hammer sear pivot pin is positioned at least partially through the hammer sear pivot aperture, such that the hammer sear is pivotable about the hammer sear pivot pin; a hammer, wherein the hammer includes an elongate hammer body portion having a hammer pivot aperture formed therethrough, wherein the hammer pivot aperture is formed proximate a bottom portion of the hammer, wherein the hammer includes a hammer face formed along at least a portion of the hammer, wherein a hammer shoulder is formed in a portion of the hammer, wherein a hammer pivot pin is positioned at least partially through the hammer pivot aperture, such that the hammer is pivotable about the hammer pivot pin, and wherein the hammer and the hammer sear are positioned relative to one another such that at least a portion of the hammer shoulder is able to at least partially contact at least a portion of the hammer sear shoulder; and a trigger bar, wherein the trigger bar comprises an elongate portion of material, having a trigger bar trigger projection extending from an area proximate a first end of the trigger bar and a trigger bar hammer sear projection extending from an area proximate a second end of the trigger bar, wherein the trigger bar is positioned such that the trigger bar trigger projection extends through or at least partially through the trigger sear link aperture and the trigger bar hammer sear projection extends through or at least partially through the hammer sear link aperture, and wherein if the trigger is rotated, the trigger releases the trigger sear, which, in turn, urges the trigger bar, which, in turn, rotates the hammer sear, which, in turn, releases the hammer.

In various exemplary, non-limiting embodiments, the trigger shoulder is formed in a portion of the trigger, proximate the trigger pivot aperture.

In various exemplary, non-limiting embodiments, the trigger shoulder is defined by a planar surface.

In various exemplary, non-limiting embodiments, the trigger pivot pin, the trigger sear pivot pin, the hammer sear pivot pin, and the hammer pivot pin are each securable to a portion of the firearm.

In various exemplary, non-limiting embodiments, the trigger sear link aperture is formed at a spaced apart location, along a longitudinal axis of the trigger sear, from the trigger sear pivot aperture.

In various exemplary, non-limiting embodiments, the trigger sear shoulder is formed in a portion of the trigger sear, proximate the trigger sear pivot aperture.

In various exemplary, non-limiting embodiments, the trigger sear shoulder is formed in a portion of the trigger sear, between the trigger sear pivot aperture and the trigger sear link aperture.

In various exemplary, non-limiting embodiments, the trigger sear shoulder is defined by a planar surface.

In various exemplary, non-limiting embodiments, the hammer sear link aperture is formed at a spaced apart location, along a longitudinal axis of the hammer sear, from the hammer sear pivot aperture.

In various exemplary, non-limiting embodiments, the hammer sear shoulder is formed in a portion of the hammer sear, proximate the hammer sear pivot aperture.

In various exemplary, non-limiting embodiments, the hammer sear shoulder is formed in a portion of the hammer sear, between the hammer sear pivot aperture and the hammer sear link aperture.

In various exemplary, non-limiting embodiments, the hammer sear shoulder is defined by a planar surface.

In various exemplary, non-limiting embodiments, the hammer shoulder is formed in a portion of the hammer, proximate the hammer pivot aperture.

In various exemplary, non-limiting embodiments, the hammer shoulder is defined by a planar surface.

In various exemplary, non-limiting embodiments, the trigger bar trigger projection and the trigger bar hammer sear projection each extend from a same side of the trigger bar.

In various exemplary, non-limiting embodiments, the trigger bar trigger projection and the trigger bar hammer sear projection each extend from a different side of the trigger bar.

In various exemplary, non-limiting embodiments, the hammer is maintained in a spring biased position, via a hammer spring.

In various exemplary, non-limiting embodiments, one or more of the hammer sear, the trigger bar, the trigger sear, and/or the trigger are maintained in a spring biased position.

In various exemplary, non-limiting embodiments, the trigger mechanism of the present disclosure provides at least some of a trigger having a trigger pivot aperture formed therethrough, wherein a trigger shoulder is formed in a portion of the trigger, and wherein a trigger pivot pin is positioned at least partially through the trigger pivot aperture, such that the trigger is pivotable about the trigger pivot pin; a trigger sear having a trigger sear pivot aperture formed therethrough and having a trigger sear link aperture formed therethrough, wherein a trigger sear shoulder is formed in a portion of the trigger sear, wherein a trigger sear pivot pin is positioned at least partially through the trigger sear pivot aperture, such that the trigger sear is pivotable about the trigger sear pivot pin, and wherein the trigger and the trigger sear are positioned relative to one another such that at least a portion of the trigger shoulder is able to at least partially contact at least a portion of the trigger sear shoulder; a hammer sear having a hammer sear pivot aperture formed therethrough and a hammer sear link aperture formed therethrough, wherein a hammer sear shoulder is formed in a portion of the hammer sear, and wherein a hammer sear pivot pin is positioned at least partially through the hammer sear pivot aperture, such that the hammer sear is pivotable about the hammer sear pivot pin; a hammer having a hammer pivot aperture formed therethrough, wherein a hammer shoulder is formed in a portion of the hammer, wherein a hammer pivot pin is positioned at least partially through the hammer pivot aperture, such that the hammer is pivotable about the hammer pivot pin, and wherein the hammer and the hammer sear are positioned relative to one another such that at least a portion of the hammer shoulder is able to at least partially contact at least a portion of the hammer sear shoulder; and a trigger bar having a trigger bar trigger projection extending from an area proximate a first end of the trigger bar and having a trigger bar hammer sear projection extending from an area proximate a second end of the trigger bar, wherein the trigger bar is positioned such that the trigger bar trigger projection extends through or at least partially through the trigger sear link aperture and the trigger bar hammer sear projection extends through or at least partially through the hammer sear link aperture, and wherein if the trigger is rotated, the trigger releases the trigger sear, which, in turn, urges the trigger bar, which, in turn, rotates the hammer sear, which, in turn, releases the hammer.

In various exemplary, non-limiting embodiments, the trigger mechanism of the present disclosure provides at least some of a trigger having a trigger pivot aperture formed therethrough, wherein a trigger shoulder is formed in a portion of the trigger, and wherein the trigger is pivotable about a trigger pivot pin; a trigger sear having a trigger sear pivot aperture formed therethrough and having a trigger sear link aperture formed therethrough, wherein a trigger sear shoulder is formed in a portion of the trigger sear, wherein the trigger sear is pivotable about a trigger sear pivot pin, and wherein the trigger and the trigger sear are positioned relative to one another such that at least a portion of the trigger shoulder is able to at least partially contact at least a portion of the trigger sear shoulder; a hammer sear having a hammer sear pivot aperture formed therethrough and a hammer sear link aperture formed therethrough, wherein a hammer sear shoulder is formed in a portion of the hammer sear, and wherein a the hammer sear is pivotable about a hammer sear pivot pin; a hammer having a hammer pivot aperture formed therethrough, wherein a hammer shoulder is formed in a portion of the hammer, wherein the hammer is pivotable about a hammer pivot pin, and wherein the hammer and the hammer sear are positioned relative to one another such that at least a portion of the hammer shoulder is able to at least partially contact at least a portion of the hammer sear shoulder; and a trigger bar having a trigger bar trigger projection extending from an area proximate a first end of the trigger bar and having a trigger bar hammer sear projection extending from an area proximate a second end of the trigger bar, wherein the trigger bar is positioned such that the trigger bar trigger projection extends through or at least partially through the trigger sear link aperture and the trigger bar hammer sear projection extends through or at least partially through the hammer sear link aperture, and wherein if the trigger is rotated, the trigger releases the trigger sear, which, in turn, urges the trigger bar, which, in turn, rotates the hammer sear, which, in turn, releases the hammer.

Accordingly, the present disclosure separately and optionally provides an improved trigger mechanism.

The present disclosure separately and optionally provides a trigger mechanism wherein the trigger is not directly connected to the trigger bar.

The present disclosure separately and optionally provides a trigger mechanism that includes a trigger that activates an initial sear, then this initial sear further activates, via relay action, a second sear.

The present disclosure separately and optionally provides a trigger mechanism that provides improved precision to the trigger of a firearm.

The present disclosure separately and optionally provides a trigger mechanism that can be easily manipulated by a user.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE DISCLOSURE

Figure 1:
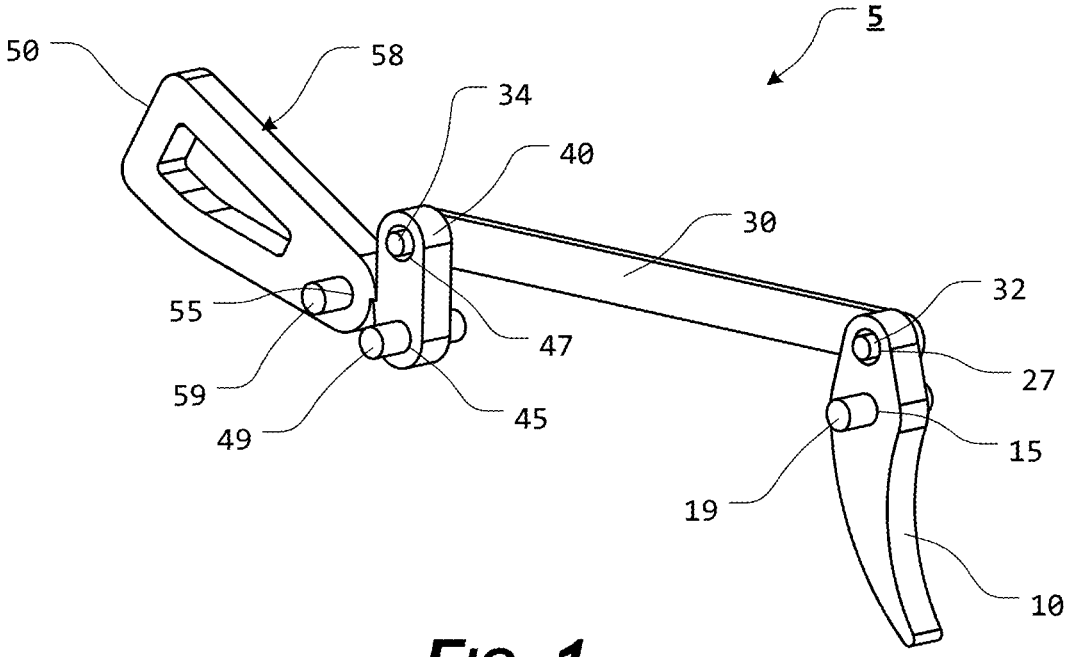
FIG. 1 PRIOR ART
FIG. 1 illustrates a front isometric view of certain exemplary components of a known embodiment of a trigger mechanism.

The foregoing and other objectives, features, and advantages of the invention will be more readily understood upon consideration of the following description of the invention taken in conjunction with the accompanying drawings.

For simplicity and clarification, the design factors and operating principles of the trigger mechanism according to the present disclosure are explained with reference to various exemplary embodiments of trigger mechanism according to the present disclosure. The basic explanation of the design factors and operating principles of the trigger mechanism is applicable for the understanding, design, and operation of the trigger mechanism of the present disclosure. It should be appreciated that the trigger mechanism can be adapted to many applications where a switch or a trigger mechanism is necessary or desirable.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that, for simplicity and clarification, certain embodiments of the present disclosure may be described using terms such as "front", "back", "rear", "right", "left", "upper", "lower", "outer", and/or "inner". However, it should be understood that these terms are merely used to aid in understanding of the present disclosure are not to be construed as limiting the systems, methods, devices, and/or apparatuses of the present disclosure. Additionally, it should be appreciated that, unless otherwise stated, the design factors and operating principles of the presently disclosed multidirectional explosive disruptor system may optionally be used in a "mirror image" assembly, wherein elements shown and/or described as being included in or on an upper or identified side portion may optionally be included in or on a lower or other side portion. Alternatively, certain of the elements that are shown and/or described as being included in or on a back portion may optionally be included in or on a front portion, or vice versa.

It should also be appreciated that the terms "trigger mechanism", "trigger", "trigger sear", "trigger bar", "hammer sear", and/or "hammer" are used for basic explanation and understanding of the operation of the systems, methods, and apparatuses of the present disclosure. Therefore, the terms "trigger mechanism", "trigger", "trigger sear", "trigger bar", "hammer sear", and/or "hammer" are not to be construed as limiting the systems, methods, and apparatuses of the present disclosure.

Furthermore, it should be appreciated that, for simplicity and clarification, the embodiments of the present disclosure will be shown and/or described with reference to the trigger mechanism being utilized as a trigger mechanism for a firearm. However, it should be appreciated that this usage is merely exemplary and is not to be construed as limiting the present disclosure. Thus, the trigger mechanism of the present disclosure may be utilized as a trigger or release for any desired device.

Figure 2:
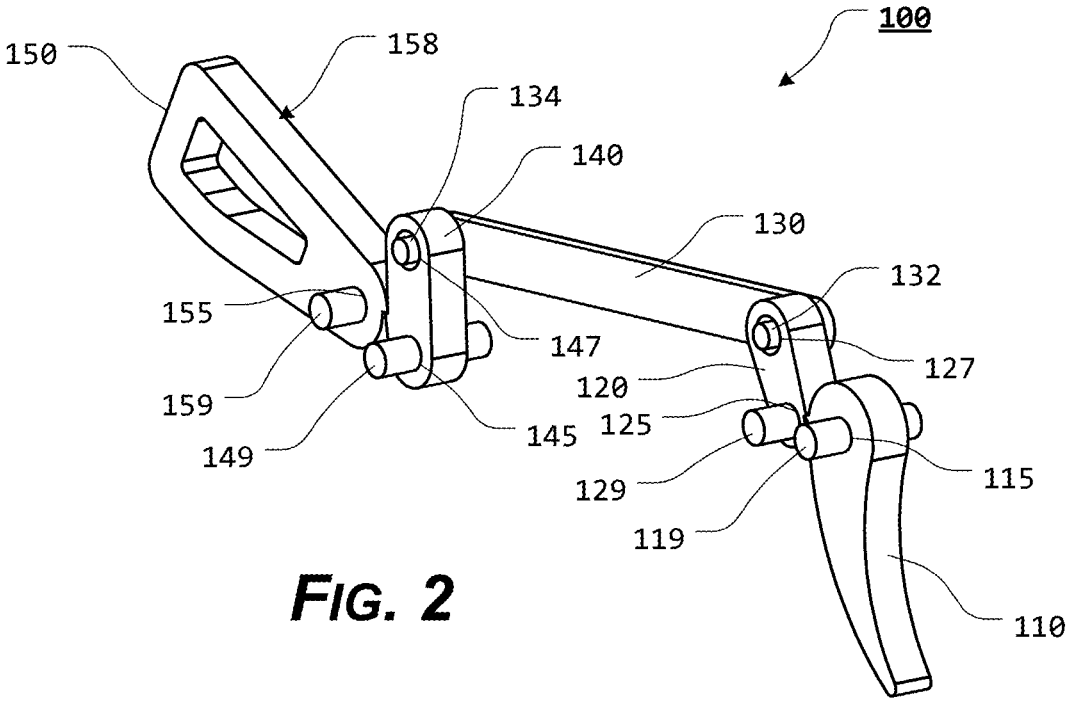
FIG. 2 illustrates an upper, front isometric view of certain exemplary components of an exemplary embodiment of a trigger mechanism, wherein the trigger mechanism is in a "cocked" position, according to the present disclosure.
Figure 3:
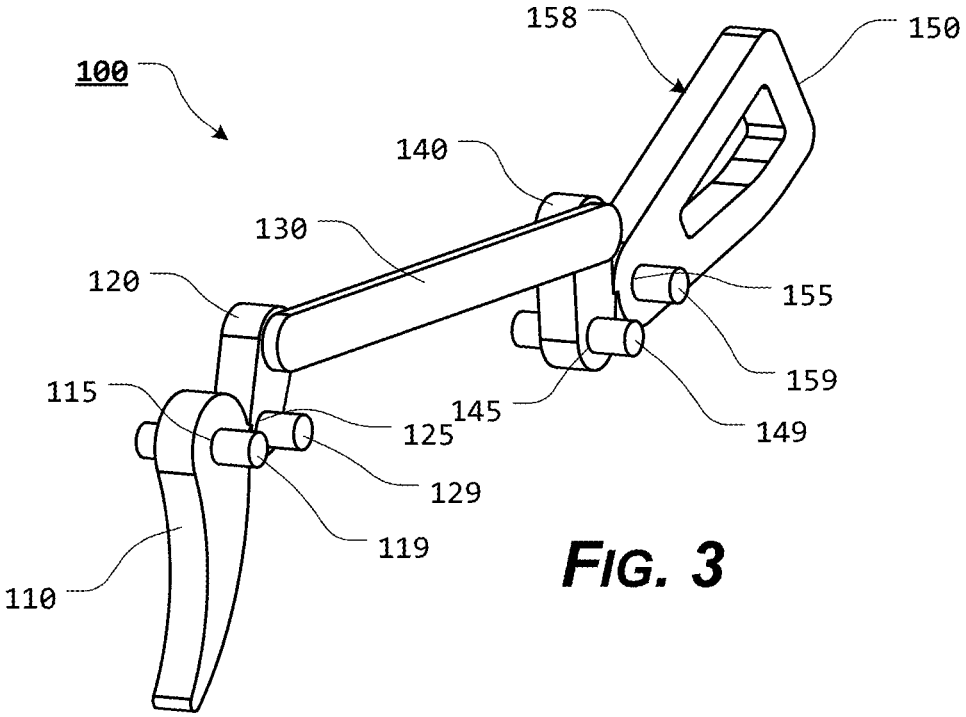
FIG. 3 illustrates an upper, front isometric view of certain exemplary components of an exemplary embodiment of a trigger mechanism, wherein the trigger mechanism is in a "cocked" position, according to the present disclosure.
Figure 4:
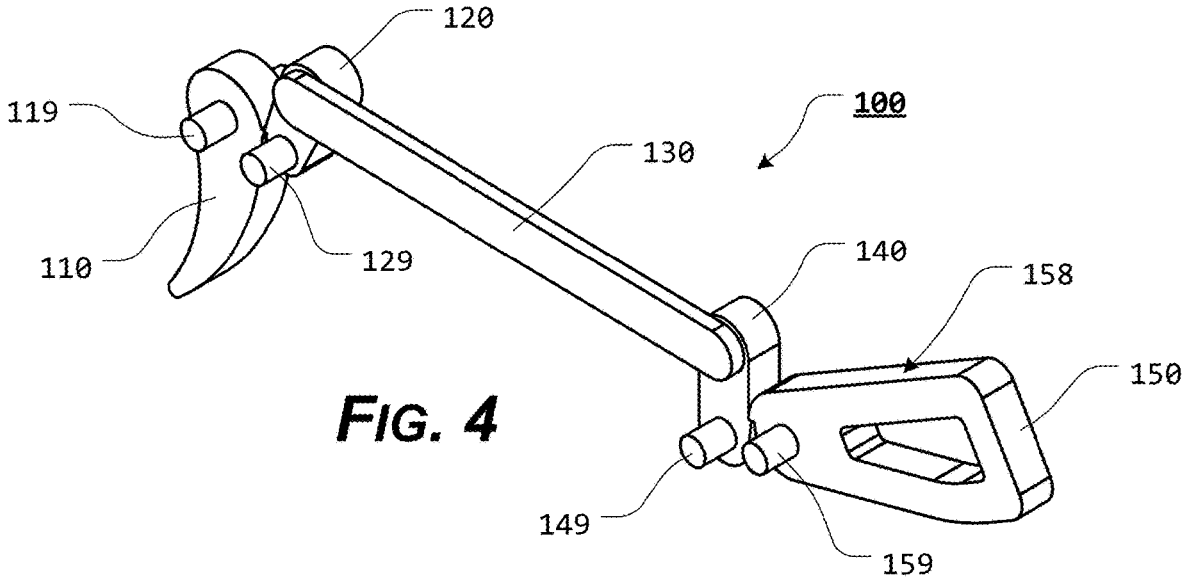
FIG. 4 illustrates an upper, rear isometric view of certain exemplary components of an exemplary embodiment of a trigger mechanism, wherein the trigger mechanism is in a "cocked" position, according to the present disclosure.
Figure 5:
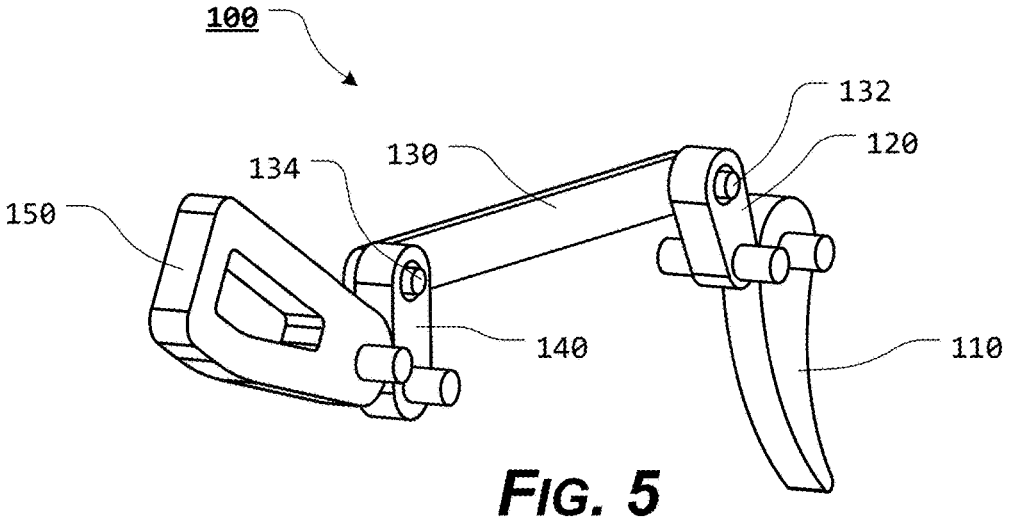
FIG. 5 illustrates an upper, rear isometric view of certain exemplary components of an exemplary embodiment of a trigger mechanism, wherein the trigger mechanism is in a "cocked" position, according to the present disclosure.
Figure 6:
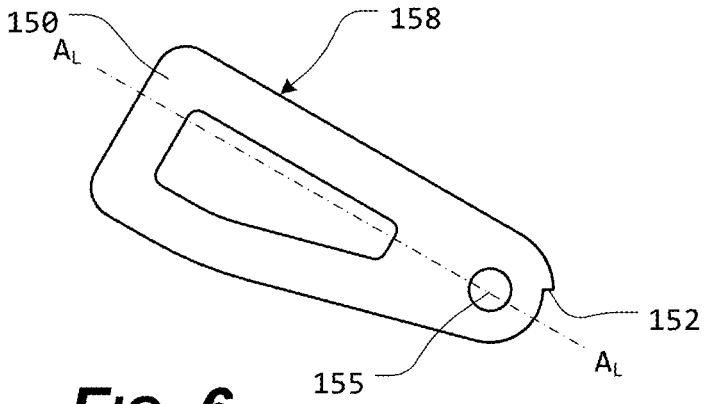
FIG. 6 illustrates a side view of an exemplary embodiment of a hammer, according to the present disclosure.
Figure 7:
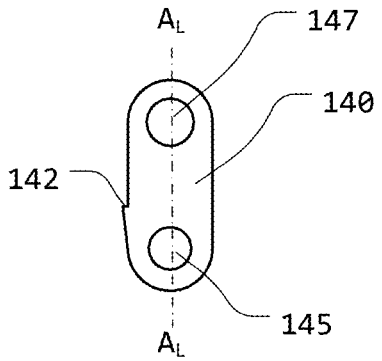
FIG. 7 illustrates a side view of an exemplary embodiment of a hammer sear, according to the present disclosure.
Figure 8:
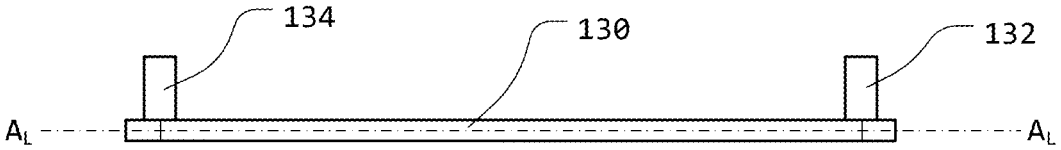
FIG. 8 illustrates a top view of an exemplary embodiment of a trigger bar, according to the present disclosure.
Figure 9:
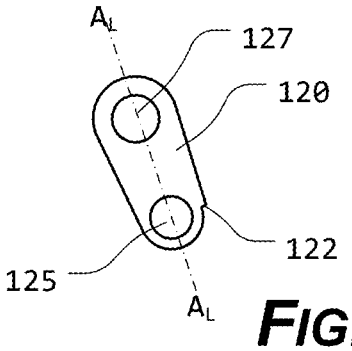
FIG. 9 illustrates a side view of an exemplary embodiment of a trigger sear, according to the present disclosure.
Figure 10:
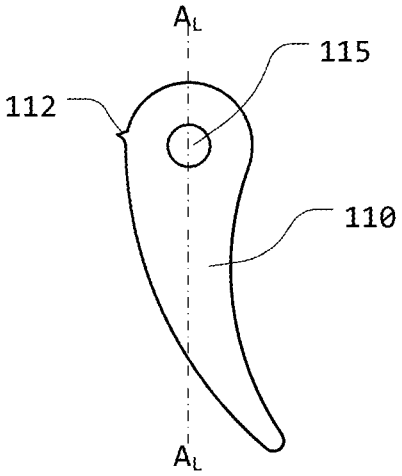
FIG. 10 illustrates a side view of an exemplary embodiment of a trigger, according to the present disclosure.
Figure 11:
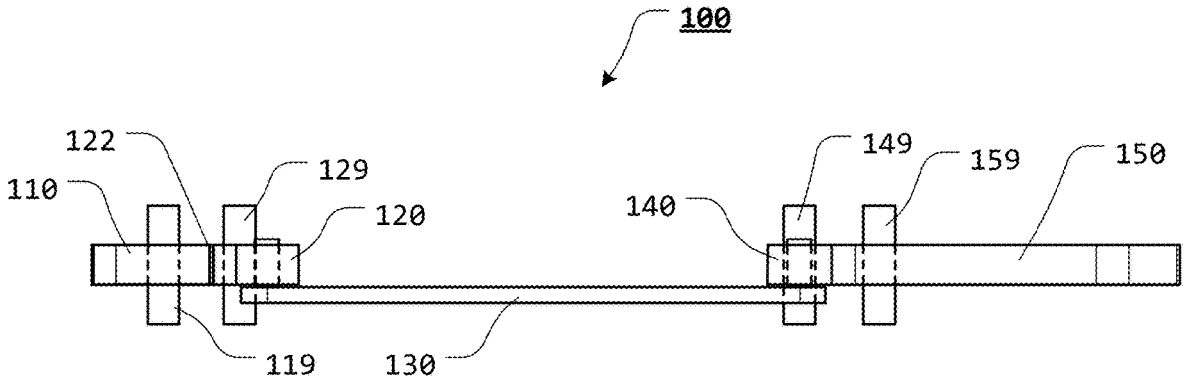
FIG. 11 illustrates a top view of certain exemplary components of an exemplary embodiment of a trigger mechanism, wherein the trigger mechanism is in a "cocked" position, according to the present disclosure.
Figure 12:
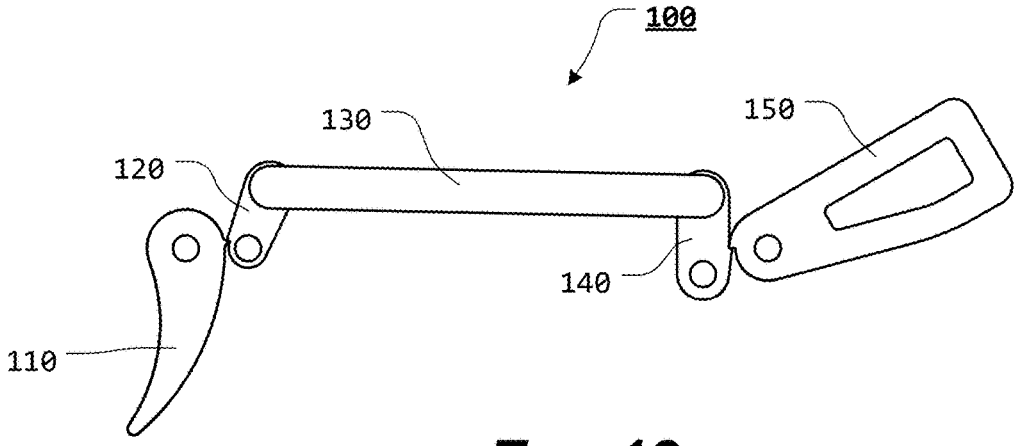
FIG. 12 illustrates a side view of certain exemplary components of an exemplary embodiment of a trigger mechanism, wherein the trigger mechanism is in a "cocked" position, according to the present disclosure.
Figure 13:
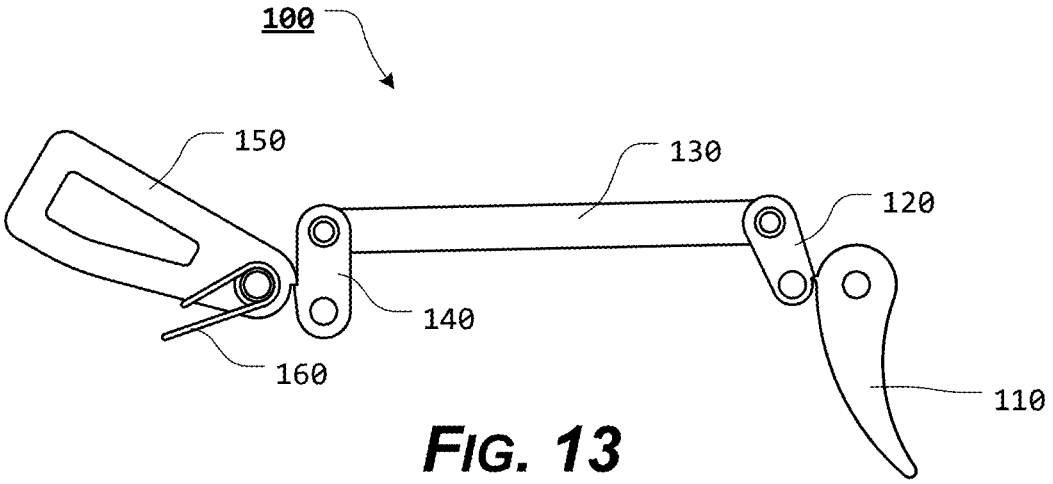
FIG. 13 illustrates a side view of certain exemplary components of an exemplary embodiment of a trigger mechanism, wherein the trigger mechanism is in a "cocked" position, according to the present disclosure.
Figure 14:
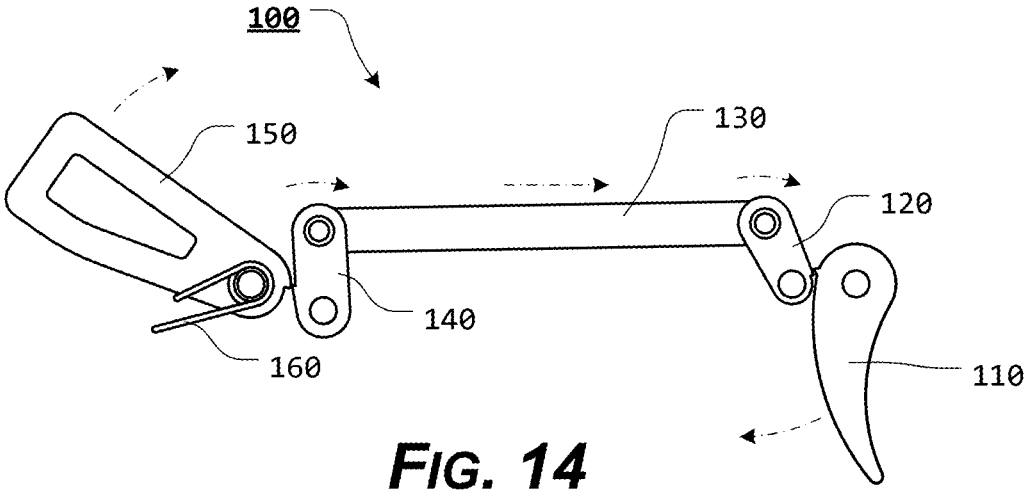
FIG. 14 illustrates a side view of certain exemplary components of an exemplary embodiment of a trigger mechanism, wherein the trigger mechanism is in transition between a "cocked" position and a "fire" position, according to the present disclosure.
Figure 15:
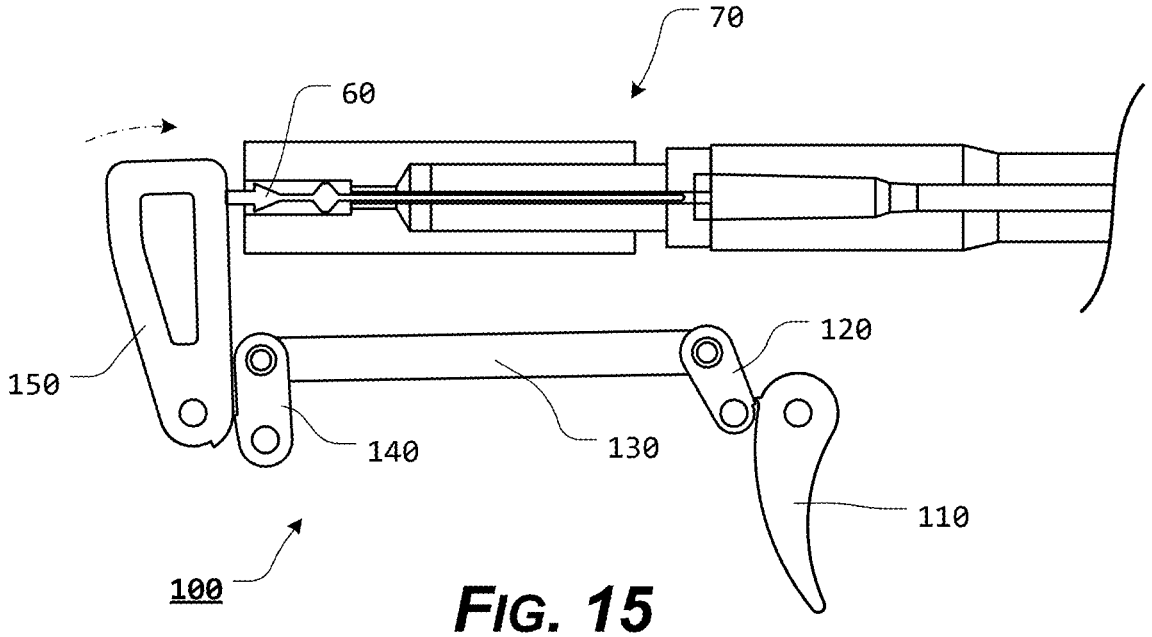
FIG. 15 illustrates a side view of certain exemplary components of an exemplary embodiment of a trigger mechanism, wherein the trigger mechanism is in a "fire" position, according to the present disclosure.

In the form of the present disclosure chosen for purposes of illustration, FIGS. 2-15 illustrate various views of certain exemplary components and/or configurations of the trigger mechanism 100 of the present disclosure.

In illustrative, non-limiting embodiment(s) of the present disclosure, as illustrated, for example, in FIGS. 2-15, the trigger mechanism 100 includes a trigger 110, a trigger sear 120, a trigger bar 130, a hammer sear 140, and a hammer 150.

As illustrated, the trigger 110 includes a trigger body portion with a trigger pivot aperture 115 formed therethrough. Trigger pivot aperture 115 is generally formed proximate a top or upper portion of the trigger 110.

A trigger shoulder 112 is formed in a portion of the trigger 110, proximate the trigger pivot aperture 115. In various exemplary embodiments, the trigger shoulder 112 is formed of a recess, recessed surface, or recessed ledge in a portion of the trigger 110. Alternatively, the trigger shoulder 112 is formed of a projection extending from a portion of the trigger 110. In various exemplary embodiments, the trigger shoulder 112 is defined by a planar surface facing upward, relative to the longitudinal axis, $A_L$, of the trigger 110.

The trigger pivot pin 119 is secured to a portion of the firearm and the trigger pivot pin 119 is positioned through or at least partially through the trigger pivot aperture 115, such that the trigger 110 is pivotable, about the trigger pivot aperture 115, by interaction of the trigger pivot aperture 115 and the trigger pivot pin 119.

The trigger sear 120 includes an elongate trigger sear body portion having a trigger sear pivot aperture 125 formed proximate a first end of the trigger sear 120 and a trigger sear link aperture 127 formed proximate a second end of the trigger sear 120. In various exemplary embodiments, the trigger sear link aperture 127 is formed at a spaced apart location, along the longitudinal axis, $A_L$, of the trigger sear 120, from the trigger sear pivot aperture 125. The trigger sear pivot aperture 125 is generally formed proximate a bottom or lower portion of the trigger sear 120, while the trigger sear link aperture 127 is formed proximate a top or upper portion of the trigger sear 120.

A trigger sear shoulder 122 is formed in a portion of the trigger sear 120, proximate the trigger sear pivot aperture 125 or between the trigger sear pivot aperture 125 and the trigger sear link aperture 127. In various exemplary embodiments, the trigger sear shoulder 122 is formed of a recess, recessed surface, or recessed ledge in a portion of the trigger sear 120. Alternatively, the trigger sear shoulder 122 is formed of a projection extending from a portion of the trigger sear 120. In various exemplary embodiments, the trigger sear shoulder 122 is defined by a planar surface facing downward, relative to the longitudinal axis, $A_L$, of the trigger sear 120.

The trigger sear pivot pin 129 is secured to a portion of the firearm and the trigger sear pivot pin 129 is positioned through or at least partially through the trigger sear pivot aperture 125, such that the trigger sear 120 is pivotable, about the trigger sear pivot aperture 125, by interaction of the trigger sear pivot aperture 125 and the trigger sear pivot pin 129.

The trigger 110 and the trigger sear 120 are positioned relative to one another such that at least a portion of the trigger shoulder 112 is able to at least partially contact and engage at least a portion of the trigger sear shoulder 122.

The hammer sear 140 includes an elongate hammer sear body portion having a hammer sear pivot aperture 145 formed proximate a first end of the hammer sear 140 and a hammer sear link aperture 147 formed proximate a second end of the hammer sear 140. In various exemplary embodiments, the hammer sear link aperture 147 is formed at a spaced apart location, along the longitudinal axis, $A_L$, of the hammer sear 140, from the hammer sear pivot aperture 145. The hammer sear pivot aperture 145 is generally formed proximate a bottom or lower portion of the hammer sear 140, while the hammer sear link aperture 147 is formed proximate a top or upper portion of the hammer sear 140.

A hammer sear shoulder 142 is formed in a portion of the hammer sear 140, proximate the hammer sear pivot aperture 145 or between the hammer sear pivot aperture 145 and the hammer sear link aperture 147. In various exemplary embodiments, the hammer sear shoulder 142 is formed of a recess, recessed surface, or recessed ledge in a portion of the hammer sear 140. Alternatively, the hammer sear shoulder 142 is formed of a projection extending from a portion of the hammer sear 140.

In various exemplary embodiments, the hammer sear shoulder 142 is defined by a planar surface facing upward, relative to the longitudinal axis, $A_L$, of the hammer sear 140.

The hammer sear pivot pin 149 is secured to a portion of the firearm and the hammer sear pivot pin 149 is positioned through or at least partially through the hammer sear pivot aperture 145, such that the hammer sear 140 is pivotable, about the hammer sear pivot aperture 145, by interaction of the hammer sear pivot aperture 145 and the hammer sear pivot pin 149.

The hammer 150 includes a hammer body portion with a hammer pivot aperture 155 formed therethrough. Hammer pivot aperture 155 is generally formed proximate a bottom or lower portion of the hammer 150. A hammer face 158 is formed along at least a portion of the hammer 150, generally proximate a top or upper portion of the hammer 150. The hammer face 158 is formed so as to contact a firing pin or other mechanism of a firearm.

A hammer shoulder 152 is formed in a portion of the hammer 150, proximate the hammer pivot aperture 155. In various exemplary embodiments, the hammer shoulder 152 is formed of a recess, recessed surface, or recessed ledge in a portion of the hammer 150. Alternatively, the hammer shoulder 152 is formed of a projection extending from a portion of the hammer 150. In various exemplary embodiments, the hammer shoulder 152 is defined by a planar surface facing downward or rearward, relative to the longitudinal axis, $A_L$, of the hammer 150.

The hammer pivot pin 159 is secured to a portion of the firearm and the hammer pivot pin 159 is positioned through or at least partially through the hammer pivot aperture 155, such that the hammer 150 is pivotable, about the hammer pivot aperture 155, by interaction of the hammer pivot aperture 155 and the hammer pivot pin 159.

The hammer 150 and the hammer sear 140 are positioned relative to one another such that at least a portion of the hammer shoulder 152 is able to at least partially contact and engage at least a portion of the hammer sear shoulder 142.

The trigger bar 130 comprises an elongate portion of material, extending along a longitudinal axis, $A_L$, and having a trigger bar trigger projection 132 extending from an area proximate a first end of the trigger bar 130 and trigger bar hammer sear projection 134 extending from an area proximate a second end of the trigger bar 130. In various exemplary embodiments, the trigger bar trigger projection 132 and the trigger bar hammer sear projection 134 each extend from the same side of the trigger bar 130. Alternatively, the trigger bar trigger projection 132 and the trigger bar hammer sear projection 134 may optionally extend from different sides of the trigger bar 130.

The trigger bar 130 is positioned such that the trigger bar trigger projection 132 extends through or at least partially through the trigger sear link aperture 127 and the trigger bar hammer sear projection 134 extends through or at least partially through the hammer sear link aperture 147.

In various exemplary embodiments, the hammer 150 is maintained in a spring biased position, via a hammer spring 160. It should be appreciated that other elements of the trigger mechanism 100, such as, for example, the hammer sear 140, the trigger bar 130, the trigger sear 120, and/or the trigger 110 may also be maintained in a spring biased position via a spring or other spring biasing element. In this manner, certain elements of the trigger mechanism 100 may be spring biased toward the "cocked" position or may be spring biased toward the "fire" position.

The trigger mechanism 100 is positioned within a firearm such that the hammer 150 can be maintained in a "cocked" position by interaction of the hammer shoulder 152 of the hammer 150 and the hammer sear shoulder 142 of the hammer sear 140 and interaction of the trigger shoulder 112 of the trigger 110 and the trigger sear shoulder 122 of the trigger sear 120. The trigger bar 130 links or couples the trigger sear 120 to the hammer sear 140, via interaction of the trigger bar trigger projection 132 with the trigger sear link aperture 127 and interaction of the trigger bar hammer sear projection 134 with the hammer sear link aperture 147.

If the hammer 150 is rotated to the "cocked" position, the trigger shoulder 112 contacts the trigger sear shoulder 122 and the hammer shoulder 152 contacts the hammer sear shoulder 142 such that the hammer 150 is maintained in the "cocked" position.

During a typical firing sequence, the trigger 110 is urged and pivotably rotated (typically rearward). As the trigger 110 is pivotably rotated, at least a portion of the surface of the trigger shoulder 112 of the trigger 110 slides relative to the trigger sear shoulder 122 of the trigger sear 120. If the rotation of the trigger 110 is sufficient, the surface of the trigger shoulder 112 of the trigger 110 is translated a sufficient distance so as to disengage the trigger sear shoulder 122 of the trigger sear 120. If the surface of the trigger shoulder 112 of the trigger 110 disengages the trigger sear shoulder 122 of the trigger sear 120 the trigger sear 120 rotates, relative to the trigger sear pivot pin 129 to move or translate the trigger bar 130. Thus, rotational movement of the trigger 110 results in a disengagement between the trigger 110 and the trigger sear 120 and movement of the trigger bar 130.

It is in various exemplary embodiments, the trigger sear 120 is spring biased toward the "fire" position, such that when the trigger sear 120 is released from the trigger 110, the trigger sear 120 is urged, via a spring biasing force, to move or translate the position of the trigger bar 130 toward the "fire" position.

The movement of the trigger bar 130 toward the "fire" position results in pivotal rotation of the hammer sear 140.

As the hammer sear 140 is pivotably rotated, at least a portion of the surface of the hammer sear shoulder 142 of the hammer sear 140 slides relative to the hammer sear shoulder 142 of the hammer 150. If the rotation of the hammer sear 140 is sufficient, the surface of the hammer sear shoulder 142 of the hammer sear 140 is translated a sufficient distance so as to disengage the hammer sear shoulder 142 of the hammer 150. If the surface of the hammer sear shoulder 142 of the hammer sear 140 disengages the hammer sear shoulder 142 of the hammer 150 a spring biasing force applied to the hammer 150 allows the hammer 150 to rotate, relative to the hammer pivot pin 159 to contact a firing pin 60 and fire or discharge the firing mechanism 70 of the firearm.

Trigger 110 is depressed, the trigger 110 releases the trigger sear 120, which, in turn, urges the trigger bar 130. The urging of the trigger bar 130 rotates the hammer sear 140 to release the hammer 150. Once the hammer 150 is released, a portion of the hammer 150 contacts a firing pin 160 to fire or discharge the firearm.

In certain exemplary embodiments, a bolt carrier or other portion of the firing mechanism of the firearm cycles or reciprocates from the blow-back, resetting or re-cocking the trigger 110, the trigger sear 120, the trigger bar 130, the hammer sear 140, and/or the hammer 150.

It should also be appreciated that a more detailed explanation of the specific dimensions of certain components of the trigger mechanism 100, instructions regarding how to install the trigger mechanism 100, additional methods for using the trigger mechanism 100, and certain other items and/or techniques necessary for the implementation and/or operation of the various exemplary embodiments of the present disclosure are not provided herein because such background information will be known to one of ordinary skill in the art. Therefore, it is believed that the level of description provided herein is sufficient to enable one of ordinary skill in the art to understand and practice the systems, methods, and apparatuses of the presentation, as described.

It should be appreciated that the trigger mechanism of the present disclosure is not limited to the embodiment illustrated and described as the trigger mechanism 100.

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A trigger mechanism, comprising:

a trigger, wherein said trigger includes a trigger body portion with a trigger pivot aperture formed therethrough, wherein said trigger pivot aperture is formed proximate an upper portion of said trigger, wherein a trigger shoulder is formed in a portion of said trigger, and wherein a trigger pivot pin is positioned at least partially through said trigger pivot aperture, such that said trigger is pivotable about said trigger pivot pin;

a trigger sear, wherein said trigger sear includes an elongate trigger sear body portion having a trigger sear pivot aperture formed proximate a first end of said trigger sear and a trigger sear link aperture formed proximate a second end of said trigger sear, wherein a trigger sear shoulder is formed in a portion of said trigger sear, wherein a trigger sear pivot pin is positioned at least partially through said trigger sear pivot aperture, such that said trigger sear is pivotable about said trigger sear pivot pin, and wherein said trigger and said trigger sear are positioned relative to one another such that at least a portion of said trigger shoulder is able to at least partially contact at least a portion of said trigger sear shoulder;

a hammer sear, wherein said hammer sear includes an elongate hammer sear body portion having a hammer sear pivot aperture formed proximate a first end of said hammer sear and a hammer sear link aperture formed proximate a second end of said hammer sear, wherein a hammer sear shoulder is formed in a portion of said hammer sear, and wherein a hammer sear pivot pin is positioned at least partially through said hammer sear pivot aperture, such that said hammer sear is pivotable about said hammer sear pivot pin;

a hammer, wherein said hammer includes an elongate hammer body portion having a hammer pivot aperture formed therethrough, wherein said hammer pivot aperture is formed proximate a bottom portion of said hammer, wherein said hammer includes a hammer face formed along at least a portion of said hammer, wherein a hammer shoulder is formed in a portion of said hammer, wherein a hammer pivot pin is positioned at least partially through said hammer pivot aperture, such that said hammer is pivotable about said hammer pivot pin, and wherein said hammer and said hammer sear are positioned relative to one another such that at least a portion of said hammer shoulder is able to at least partially contact at least a portion of said hammer sear shoulder; and a trigger bar, wherein said trigger bar comprises an elongate portion of material, having a trigger bar trigger projection extending from an area proximate a first end of said trigger bar and a trigger bar hammer sear projection extending from an area proximate a second end of said trigger bar, wherein said trigger bar is positioned such that said trigger bar trigger projection extends through or at least partially through said trigger sear link aperture and said trigger bar hammer sear projection extends through or at least partially through said hammer sear link aperture, and wherein if said trigger is rotated, said trigger releases said trigger sear, which, in turn, urges said trigger bar, which, in turn, rotates said hammer sear, which, in turn, releases said hammer.

2. The trigger mechanism of claim 1, wherein said trigger shoulder is formed in a portion of said trigger, proximate said trigger pivot aperture.

3. The trigger mechanism of claim 1, wherein said trigger shoulder is defined by a planar surface.

4. The trigger mechanism of claim 1, wherein said trigger pivot pin, said trigger sear pivot pin, said hammer sear pivot pin, and said hammer pivot pin are each securable to a portion of said firearm.

5. The trigger mechanism of claim 1, wherein said trigger sear link aperture is formed at a spaced apart location, along a longitudinal axis of said trigger sear, from said trigger sear pivot aperture.

6. The trigger mechanism of claim 1, wherein said trigger sear shoulder is formed in a portion of said trigger sear, proximate said trigger sear pivot aperture.

7. The trigger mechanism of claim 1, wherein said trigger sear shoulder is formed in a portion of said trigger sear, between said trigger sear pivot aperture and said trigger sear link aperture.

8. The trigger mechanism of claim 1, wherein said trigger sear shoulder is defined by a planar surface.

9. The trigger mechanism of claim 1, wherein said hammer sear link aperture is formed at a spaced apart location, along a longitudinal axis of said hammer sear, from said hammer sear pivot aperture.

10. The trigger mechanism of claim 1, wherein said hammer sear shoulder is formed in a portion of said hammer sear, proximate said hammer sear pivot aperture.

11. The trigger mechanism of claim 1, wherein said hammer sear shoulder is formed in a portion of said hammer sear, between said hammer sear pivot aperture and said hammer sear link aperture.

12. The trigger mechanism of claim 1, wherein said hammer sear shoulder is defined by a planar surface.

13. The trigger mechanism of claim 1, wherein said hammer shoulder is formed in a portion of said hammer, proximate said hammer pivot aperture.

14. The trigger mechanism of claim 1, wherein said hammer shoulder is defined by a planar surface.

15. The trigger mechanism of claim 1, wherein said trigger bar trigger projection and said trigger bar hammer sear projection each extend from a same side of said trigger bar.

16. The trigger mechanism of claim 1, wherein said trigger bar trigger projection and said trigger bar hammer sear projection each extend from a different side of said trigger bar.

17. The trigger mechanism of claim 1, wherein said hammer is maintained in a spring biased position, via a hammer spring.

18. The trigger mechanism of claim 1, wherein one or more of said hammer sear, said trigger bar, said trigger sear, and/or said trigger are maintained in a spring biased position.

19. A trigger mechanism, comprising:

a trigger having a trigger pivot aperture formed therethrough, wherein a trigger shoulder is formed in a portion of said trigger, and wherein a trigger pivot pin is positioned at least partially through said trigger pivot aperture, such that said trigger is pivotable about said trigger pivot pin;

a trigger sear having a trigger sear pivot aperture formed therethrough and having a trigger sear link aperture formed therethrough, wherein a trigger sear shoulder is formed in a portion of said trigger sear, wherein a trigger sear pivot pin is positioned at least partially through said trigger sear pivot aperture, such that said trigger sear is pivotable about said trigger sear pivot pin, and wherein said trigger and said trigger sear are positioned relative to one another such that at least a portion of said trigger shoulder is able to at least partially contact at least a portion of said trigger sear shoulder;

a hammer sear having a hammer sear pivot aperture formed therethrough and a hammer sear link aperture formed therethrough, wherein a hammer sear shoulder is formed in a portion of said hammer sear, and wherein a hammer sear pivot pin is positioned at least partially through said hammer sear pivot aperture, such that said hammer sear is pivotable about said hammer sear pivot pin;

a hammer having a hammer pivot aperture formed therethrough, wherein a hammer shoulder is formed in a portion of said hammer, wherein a hammer pivot pin is positioned at least partially through said hammer pivot aperture, such that said hammer is pivotable about said hammer pivot pin, and wherein said hammer and said hammer sear are positioned relative to one another such that at least a portion of said hammer shoulder is able to at least partially contact at least a portion of said hammer sear shoulder; and a trigger bar having a trigger bar trigger projection extending from an area proximate a first end of said trigger bar and having a trigger bar hammer sear projection extending from an area proximate a second end of said trigger bar, wherein said trigger bar is positioned such that said trigger bar trigger projection extends through or at least partially through said trigger sear link aperture and said trigger bar hammer sear projection extends through or at least partially through said hammer sear link aperture, and wherein if said trigger is rotated, said trigger releases said trigger sear, which, in turn, urges said trigger bar, which, in turn, rotates said hammer sear, which, in turn, releases said hammer.

20. A trigger mechanism, comprising:

a trigger having a trigger pivot aperture formed therethrough, wherein a trigger shoulder is formed in a portion of said trigger, and wherein said trigger is pivotable about a trigger pivot pin;

a trigger sear having a trigger sear pivot aperture formed therethrough and having a trigger sear link aperture formed therethrough, wherein a trigger sear shoulder is formed in a portion of said trigger sear, wherein said trigger sear is pivotable about a trigger sear pivot pin, and wherein said trigger and said trigger sear are positioned relative to one another such that at least a portion of said trigger shoulder is able to at least partially contact at least a portion of said trigger sear shoulder;

a hammer sear having a hammer sear pivot aperture formed therethrough and a hammer sear link aperture formed therethrough, wherein a hammer sear shoulder is formed in a portion of said hammer sear, and wherein a said hammer sear is pivotable about a hammer sear pivot pin;

a hammer having a hammer pivot aperture formed therethrough, wherein a hammer shoulder is formed in a portion of said hammer, wherein said hammer is pivotable about a hammer pivot pin, and wherein said hammer and said hammer sear are positioned relative to one another such that at least a portion of said hammer shoulder is able to at least partially contact at least a portion of said hammer sear shoulder; and a trigger bar having a trigger bar trigger projection extending from an area proximate a first end of said trigger bar and having a trigger bar hammer sear projection extending from an area proximate a second end of said trigger bar, wherein said trigger bar is positioned such that said trigger bar trigger projection extends through or at least partially through said trigger sear link aperture and said trigger bar hammer sear projection extends through or at least partially through said hammer sear link aperture, and wherein if said trigger is rotated, said trigger releases said trigger sear, which, in turn, urges said trigger bar, which, in turn, rotates said hammer sear, which, in turn, releases said hammer.

* * * * *